US011952237B2

(12) United States Patent
Lin

(10) Patent No.: US 11,952,237 B2
(45) Date of Patent: Apr. 9, 2024

(54) PNEUMATIC TRANSMISSION DEVICE

(71) Applicant: Foxlink Image Technology Co., Ltd., New Taipei (TW)

(72) Inventor: Ming Wei Lin, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 206 days.

(21) Appl. No.: 17/532,512

(22) Filed: Nov. 22, 2021

(65) Prior Publication Data

US 2022/0315365 A1 Oct. 6, 2022

(30) Foreign Application Priority Data

Mar. 30, 2021 (CN) ..... 202120651594.8

(51) Int. Cl.
*B65H 5/22* (2006.01)
*B65H 5/38* (2006.01)

(52) U.S. Cl.
CPC ..... *B65H 5/228* (2013.01); *B65H 5/38* (2013.01)

(58) Field of Classification Search
CPC . B65H 5/22; B65H 5/228; B65H 5/36; B65H 5/38; B65H 2406/12; B65H 2406/122; B65H 2801/03; B65H 2801/39
USPC ..... 271/194, 195
See application file for complete search history.

(56) References Cited

U.S. PATENT DOCUMENTS 7,011,307 B2 * 3/2006 Obama ..... B65H 5/38 271/265.01
7,726,649 B2 * 6/2010 Domoto ..... G03G 15/6529 399/92
9,505,571 B2 * 11/2016 Kayani ..... B65H 5/062

FOREIGN PATENT DOCUMENTS

EP 1970334 A2 * 9/2008 ..... B65G 51/03

* cited by examiner

*Primary Examiner* — Leslie A Nicholson, III
(74) *Attorney, Agent, or Firm* — Lin & Associates Intellectual Property, Inc.

(57) ABSTRACT

A pneumatic transmission device includes a transmitting channel, an air inlet and an air supply device. The transmitting channel includes a first feeding path, a second feeding path, and a compressing path communicated between the first feeding path and the second feeding path. The compressing path is gradually inclined downward and rearward from a front end of the compressing path to a rear end of the compressing path. The second feeding path is equipped with a scanning unit. The air inlet is slantwise extended upward and frontward from a top wall of the transmitting channel. An inside of the air inlet defines a passageway. The passageway is connected with the second feeding path. The air supply device is connected to the passageway. The air supply device injects high pressure air into the passageway.

4 Claims, 8 Drawing Sheets

PNEUMATIC TRANSMISSION DEVICE

CROSS-REFERENCE TO RELATED APPLICATION

The present application is based on, and claims priority from, China Patent Application No. 202120651594.8, filed Mar. 30, 2021, the disclosure of which is hereby incorporated by reference herein in its entirety.

BACKGROUND OF THE INVENTION

1. Field of the Invention

The present invention generally relates to a pneumatic transmission device, and more particularly to a pneumatic transmission device for proceeding with a paper transmission by a high pressure airflow.

2. The Related Art

A conventional scanner transmits paper by a feeding mechanism of a transmission device. The transmission device generally includes a variety of rollers, belts, gears and motors, and other components. The feeding mechanism of the transmission device of the conventional scanner feeds paper into the conventional scanner through a pickup roller, and then the paper is transmitted to a scanning area by a transmitting roller. At last, the paper is fed out of the conventional scanner by a feed-out roller. The pickup roller, the transmitting roller and the feed-out roller are driven by a motor. The motor drives the pickup roller, the transmitting roller and the feed-out roller to transmit a driving force to the paper by the gears or the belts, so that a paper transmission effect is realized.

However, the conventional scanner needs too many necessary components, so the conventional scanner needs more working time to assemble all the necessary components. Moreover, when the paper is transmitted, the conventional scanner needs a higher assembly accuracy to maintain a paper transmission stability, and the conventional scanner needs more space to accommodate all the necessary components, so that an appearance dimension of the conventional scanner is limited.

Therefore, it is necessary to provide an innovative pneumatic transmission device for proceeding with a paper transmission by a high pressure airflow, the innovative pneumatic transmission device is capable of maintaining a transmission function and saving a required dimension in a configuration of the pneumatic transmission device.

SUMMARY OF THE INVENTION

An object of the present invention is to provide a pneumatic transmission device for proceeding with a paper transmission by a high pressure airflow. The pneumatic transmission device is adapted for being mounted to a scanner or a printer. The pneumatic transmission device includes a transmitting channel, an air inlet and an air supply device. The transmitting channel includes a first feeding path, a second feeding path, and a compressing path communicated between the first feeding path and the second feeding path. The compressing path is gradually inclined downward and rearward from a front end of the compressing path to a rear end of the compressing path. A top of the second feeding path is equipped with a scanning unit. The front end of the compressing path is connected to the first feeding path. The rear end of the compressing path is connected to the second feeding path. The air inlet is slantwise extended upward and frontward from a middle of a top wall of the transmitting channel. An inside of the air inlet defines a passageway penetrating through a top and a bottom of the air inlet. The passageway is connected with the second feeding path. A bottom of the passageway is adjacent to the rear end of the compressing path. The air supply device is connected to the passageway of the air inlet. The air supply device injects high pressure air into the passageway of the air inlet. When the high pressure air flows into the second feeding path via the bottom of the passageway, air in the second feeding path is accelerated to flow towards an exit end of the second feeding path by an affection of the high pressure air, at the moment, an air pressure in the second feeding path is less than an air pressure in the first feeding path, so that air in the first feeding path flows into the second feeding path, and a Venturi effect is formed among the passageway, the first feeding path, the compressing path and the second feeding path of the transmitting channel, an adsorption force towards the second feeding path is generated in the first feeding path, the high pressure air flows out of the pneumatic transmission device from the exit end of the second feeding path.

Another object of the present invention is to provide a pneumatic transmission device adapted for being mounted to a scanner or a printer. The pneumatic transmission device includes a chamber, a transmitting channel, an air inlet, an air supply device and a paper feeding section. An initiating end of the transmitting channel is connected with the chamber. The transmitting channel is equipped with a scanning unit or a printing unit. The air inlet is extended upward from a top wall of the transmitting channel. An inside of the air inlet defines a passageway penetrating through a top and a bottom of the air inlet. The passageway is communicated with the chamber. A top end of the air inlet is connected with the air supply device. The passageway is connected with the air supply device. The air supply device injects high pressure air into the passageway of the air inlet. The paper feeding section has a paper feeding channel. A top and a bottom of the paper feeding channel gradually shrinks towards each other from an importing end of the paper feeding channel to an exporting end of the paper feeding channel. A rear end of the paper feeding section is inserted into the chamber, so that the rear end of the paper feeding section is surrounded by the chamber. When the high pressure air enters the chamber from the passageway, one part of the high pressure air flows into the transmitting channel directly, and the other part of the high pressure air flows in the chamber to generate a circular air flow in the chamber, and then the other part of the high pressure air flows into the transmitting channel.

Another object of the present invention is to provide a pneumatic transmission device adapted for proceeding with a paper transmission. The pneumatic transmission device includes a transmitting channel, an air inlet and an air supply device. The transmitting channel includes a first feeding path. A top of a tail end of the first feeding path is gradually inclined downward and rearward to form a compressing path. A rear end of the compressing path extends rearward to form a second feeding path. The compressing path is gradually inclined downward and rearward from a front end of the compressing path to a rear end of the compressing path. A height of the first feeding path is higher than a height of the second feeding path along a vertical direction. A top of the second feeding path is equipped with a scanning unit. The air inlet is slantwise extended upward and frontward from a middle of a top wall of the transmitting channel. An inside of the air inlet defines a passageway penetrating through a top and a bottom of the air inlet. The passageway is connected with the second feeding path. A width of the passageway between two side walls of the passageway is wider than a width of the transmitting channel between the top wall and a bottom wall of the transmitting channel. The air supply device is connected to the passageway of the air inlet. The air supply device injects high pressure air into the passageway of the air inlet. When the high pressure air flows into the second feeding path via the passageway, air in the second feeding path is accelerated to flow towards an exit end of the second feeding path by an affection of the high pressure air, at the moment, an air pressure in the second feeding path is less than an air pressure in the first feeding path, so that air in the first feeding path flows into the second feeding path, and a Venturi effect is formed between the passageway and the transmitting channel, an adsorption force towards the second feeding path is generated in the first feeding path, the high pressure air flows out of the pneumatic transmission device from the exit end of the second feeding path.

As described above, the high pressure airflow is injected into the passageway to form the Venturi effect by virtue of the air inlet of the pneumatic transmission device, so that the paper is attracted into the pneumatic transmission device by the adsorption force generated via the Venturi effect. Therefore, a mechanical structure design of the pneumatic transmission device is simplified, and the pneumatic transmission device achieves a paper scanning effect. Furthermore, the pneumatic transmission device is used for proceeding with the paper transmission by the high pressure airflow, the pneumatic transmission device is capable of maintaining a transmission function and saving a required dimension in a configuration of the pneumatic transmission device.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
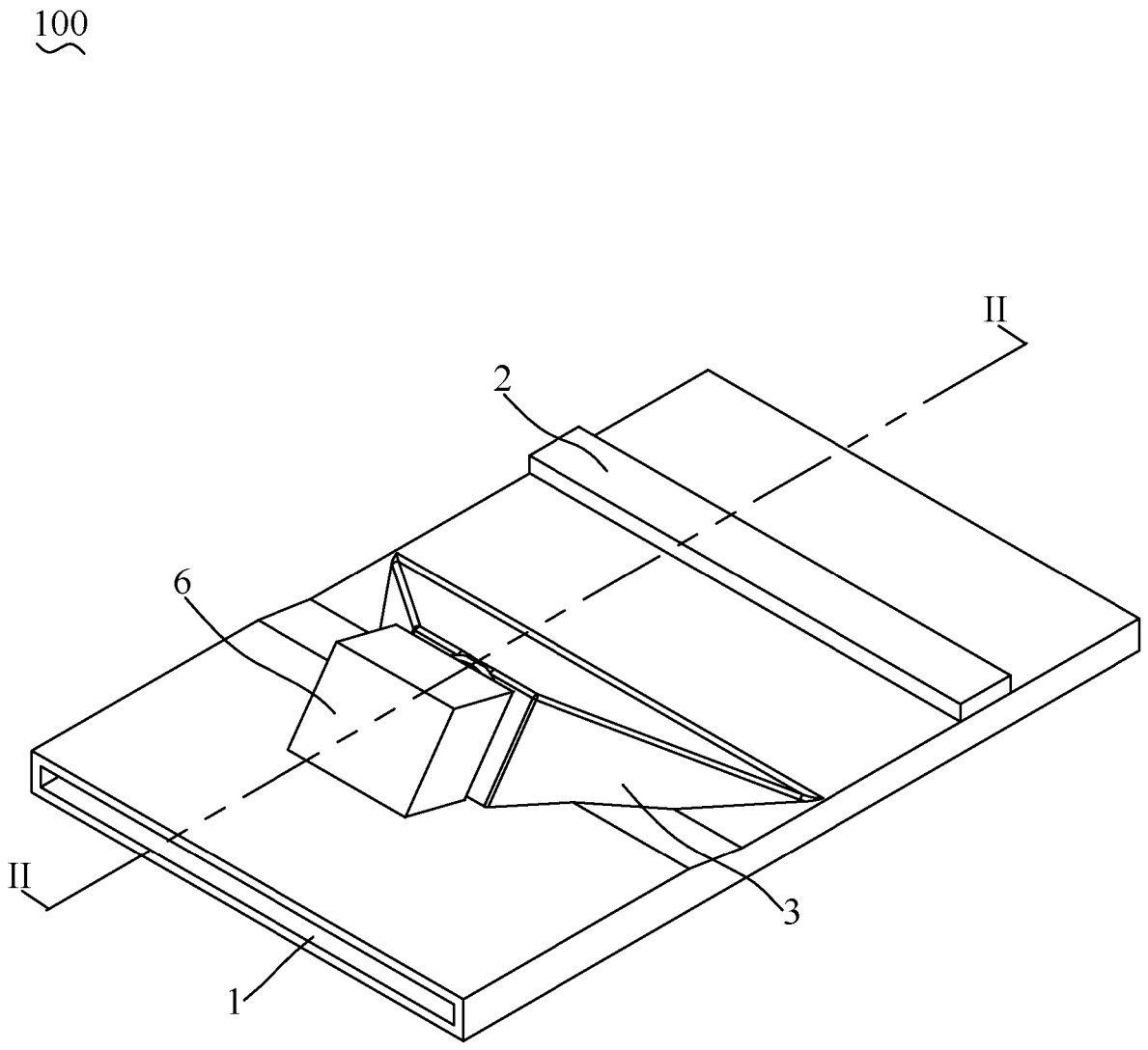
FIG. 1 is a perspective view of a pneumatic transmission device in accordance with a first preferred embodiment of the present invention.
Figure 2:
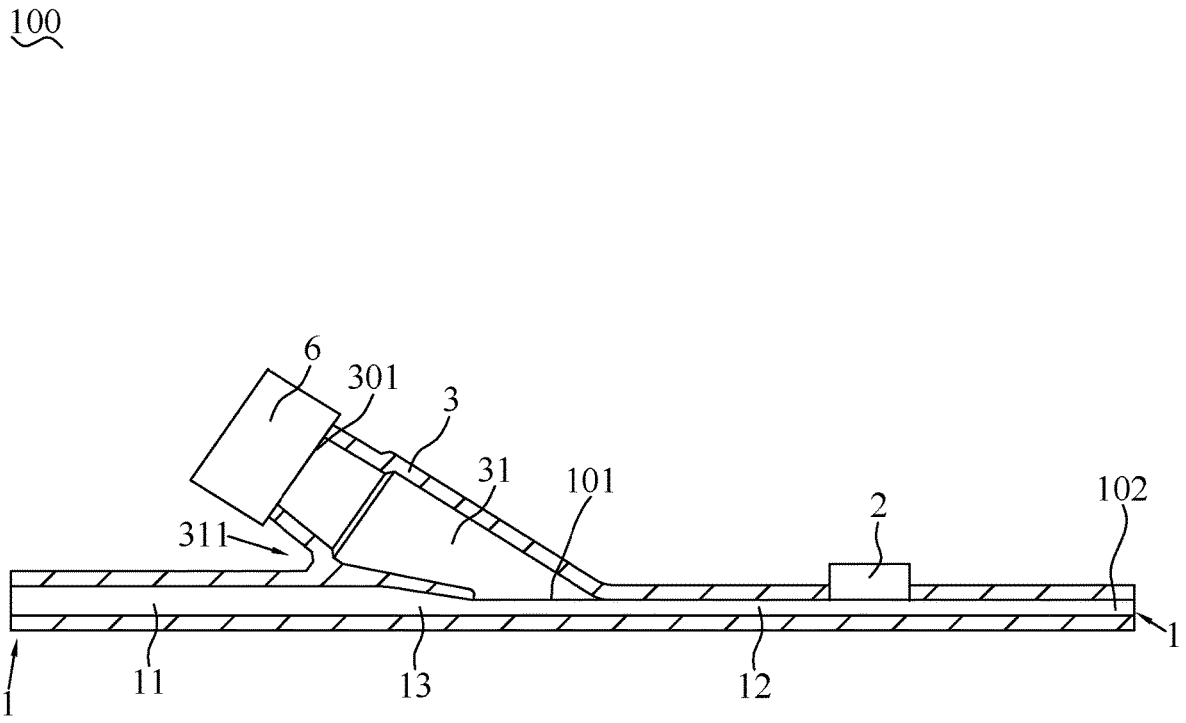
FIG. 2 is a sectional view of the pneumatic transmission device along a line II-II of FIG. 1.

Referring to FIG. 1 and FIG. 2, a pneumatic transmission device 100 in accordance with a first preferred embodiment of the present invention is shown. The pneumatic transmission device 100 is adapted for being mounted to a scanner or a printer (not shown). The pneumatic transmission device 100 is adapted for proceeding with a paper transmission. The pneumatic transmission device 100 includes a transmitting channel 1, an air inlet 3 and an air supply device 6.

Referring to FIG. 1, FIG. 2, FIG. 5 and FIG. 6, The transmitting channel 1 is disposed horizontally. The transmitting channel 1 includes a first feeding path 11, a second feeding path 12 and a compressing path 13. A height of the first feeding path 11 is higher than a height of the second feeding path 12 along a vertical direction. The compressing path 13 is communicated between the first feeding path 11 and the second feeding path 12. A top of a tail end of the first feeding path 11 is gradually inclined downward and rearward to form the compressing path 13. The compressing path 13 is connected with an open end 101 of the second feeding path 12.

A top of the second feeding path 12 of the transmitting channel 1 is equipped with a scanning unit 2 or a printing unit. A front end of the compressing path 13 is connected to the first feeding path 11. A rear end of the compressing path 13 is connected to the second feeding path 12. The rear end of the compressing path 13 extends rearward to form the second feeding path 12. The compressing path 13 is gradually inclined downward and rearward from the front end of the compressing path 13 to the rear end of the compressing path 13.

The air inlet 3 is slantwise extended upward and frontward from a middle of a top wall 401 of the transmitting channel 1. The air inlet 3 is slantwise extended upward and frontward from a top of the open end 101 of the second feeding path 12. The open end 101 penetrates through the top wall 401 of the transmitting channel 1. The air inlet 3 is connected with the open end 101 of the second feeding path 12. An inside of the air inlet 3 defines a passageway 31 penetrating through a top and a bottom of the air inlet 3. A bottom of the passageway 31 is adjacent to the rear end of the compressing path 13. The passageway 31 is connected with the open end 101 of the second feeding path 12. The passageway 31 is communicated with the transmitting channel 1 through the open end 101 of the second feeding path 12. The passageway 31 is communicated with the open end 101 of the second feeding path 12. An entry end of the passageway 31 is shown as a circular aperture 301. The passageway 31 gradually expands outward along an inclined direction of the air inlet 3 and towards the open end 101 of the second feeding path 12. A width of a bottom end of the passageway 31 is the same as a width of the open end 101 of the second feeding path 12 along a longitudinal direction. The bottom end of passageway 31 is connected with the open end 101 of the second feeding path 12. A width of the passageway 31 between two side walls of the passageway 31 is wider than a width of the transmitting channel 1 between the top wall and a bottom wall 402 of the transmitting channel 1.

The air supply device 6 is connected to the aperture 301 of the passageway 31 of the air inlet 3. The air supply device 6 injects high pressure air into the passageway 31 of the air inlet 3. The passageway 31 is disposed obliquely. The passageway 31 is disposed at an inclined angle with respect to the transmitting channel 1. A top wall of the first feeding path 11 of the transmitting channel 1 intersects with a lower wall of the passageway 31 to form an intersection angle 311 between the passageway 31 and the transmitting channel 1, so that the high pressure air of the passageway 31 is more completely transmitted into the second feeding path 12. The intersection angle 311 is an acute angle. A condition of the high pressure air flowing back into the first feeding path 11 is lowered, so that the high pressure air is prevented from affecting a paper adsorption ability of the first feeding path 11.

When the high pressure air flows into the second feeding path 12 via the bottom of the passageway 31, the air in the second feeding path 12 is accelerated to flow towards an exit end 102 of the second feeding path 12 by an affection of the high pressure air, at the moment, an air pressure in the second feeding path 12 is less than an air pressure in the first feeding path 11 to form a pressure difference. The pressure difference between the first feeding path 11 and the second feeding path 12 prompts that the air flows from a position with a higher air pressure to a position with a lower air pressure, so that the air in the first feeding path 11 flows into the second feeding path 12, and then a Venturi effect is formed among the passageway 31, the first feeding path 11, the compressing path 13 and the second feeding path 12 of the transmitting channel 1, an adsorption force towards the second feeding path 12 is generated in the first feeding path 11, the high pressure air flows out of the pneumatic transmission device 100 from the exit end 102 of the second feeding path 12.

When a place is near the air flowing at a high speed, the air pressure of the place is reduced, so that an adsorption effect is generated, and this phenomenon is called the Venturi effect. Therefore, a flow of the high pressure air in the passageway 31 and the second feeding path 12, the air pressure in the first feeding path 11 is reduced, and an adsorption force towards the second feeding path 12 is generated in the first feeding path 11. When the paper is in the first feeding path 11, the paper is attracted by the adsorption force of the second feeding path 12, so the paper moves from the first feeding path 11 to the second feeding path 12. When the paper is in the second feeding path 12, the paper in the second feeding path 12 is pushed by the high pressure air to continue moving, and when the paper passes under the scanning unit 2 located in the second feeding path 12, the scanning unit 2 scans the paper. The paper passes through the second feeding path 12, and the paper is finally fed out of the pneumatic transmission device 100.

Because an airflow speed is changed according to changes of cross-sectional areas of the airflow, when the air flows, the cross-sectional area of the airflow is reduced, and the airflow speed reaches the maximum value at the time of the cross-sectional area of the airflow being the narrowest, namely when the cross-sectional area of the airflow gradually becomes smaller, the airflow speed gradually becomes faster The air in the first feeding path 11 flows into the second feeding path 12 through the compressing path 13, and a cross-sectional area of the compressing path 13 gradually becomes narrower from the front end of the compressing path 13 to the rear end of the compressing path 13, so the airflow speed gradually becomes faster from the first feeding path 11 with the higher height to the second feeding path 12 with the lower height, so the paper adsorption effect of the first feeding path 11 is enhanced, and the paper is transmitted to the second feeding path 12.

Figure 3:
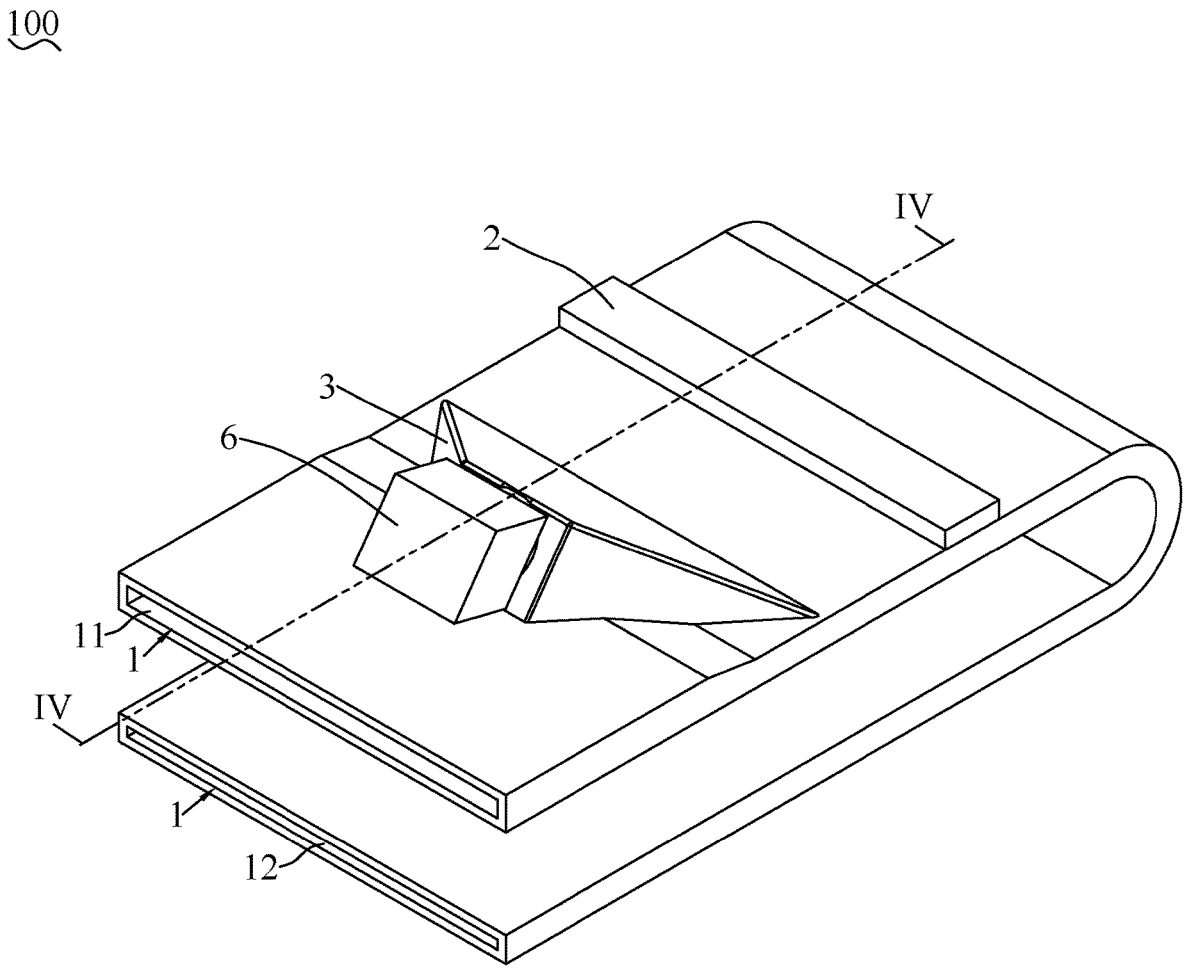
FIG. 3 is a perspective view of the pneumatic transmission device in accordance with a second preferred embodiment of the present invention.
Figure 4:
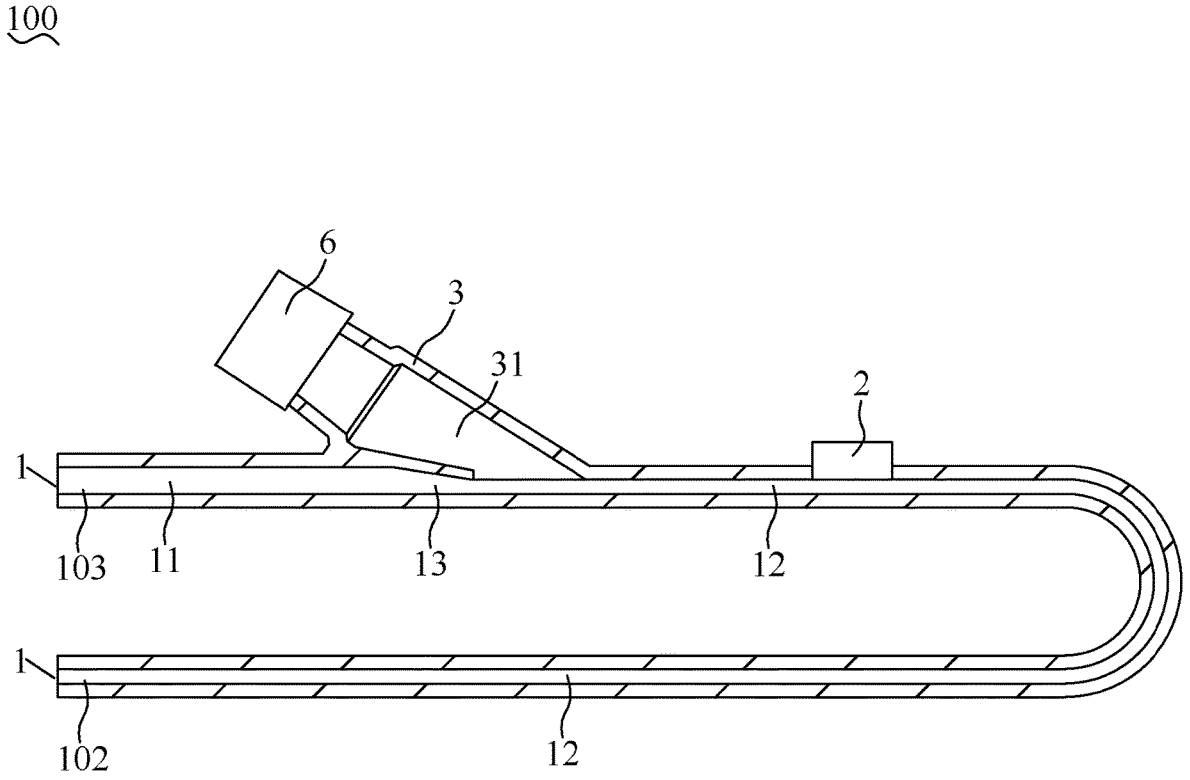
FIG. 4 is a sectional view of the pneumatic transmission device along a line IV-IV of FIG. 3.
Figure 5:
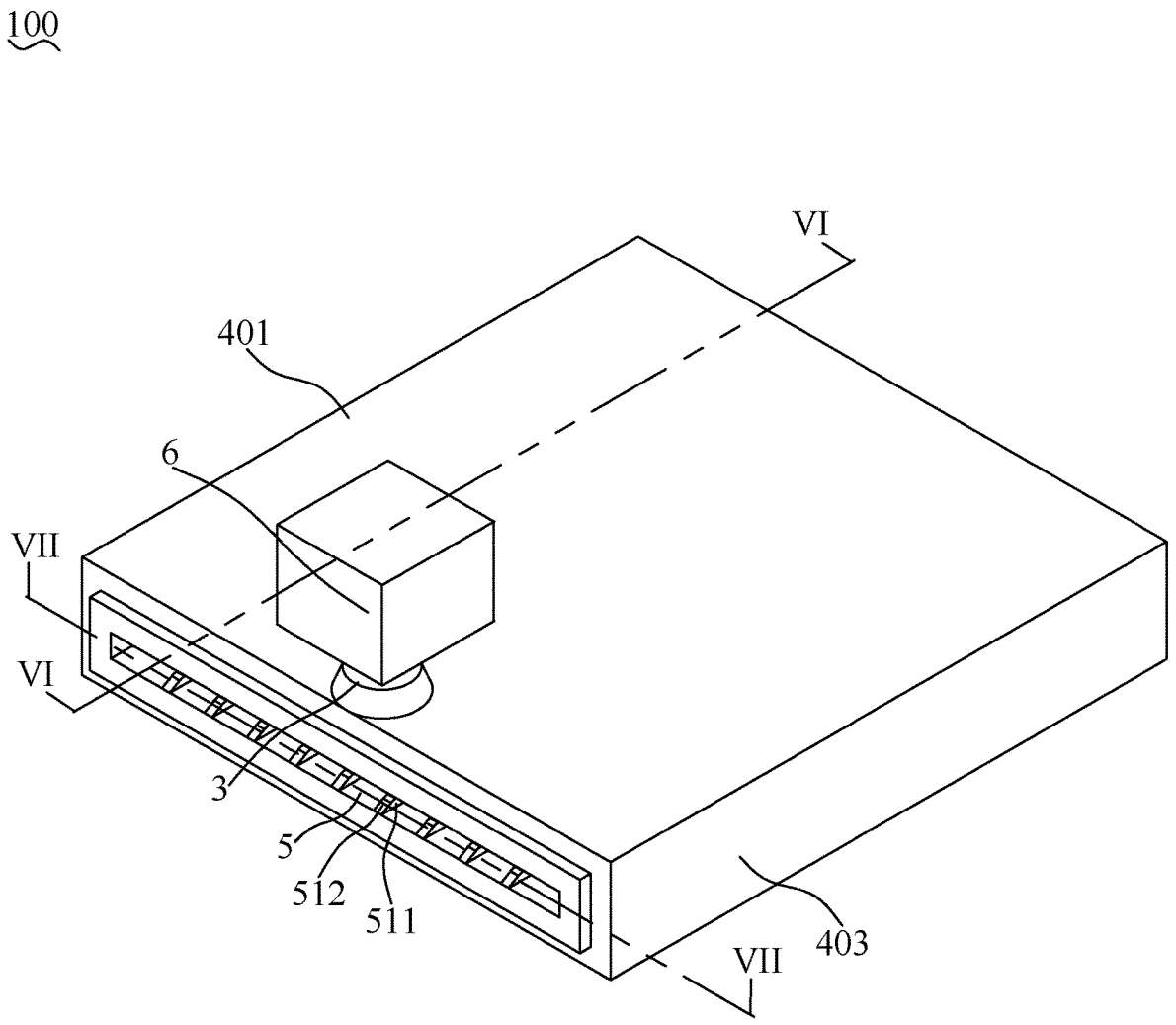
FIG. 5 is a perspective view of the pneumatic transmission device in accordance with a third preferred embodiment of the present invention.
Figure 6:
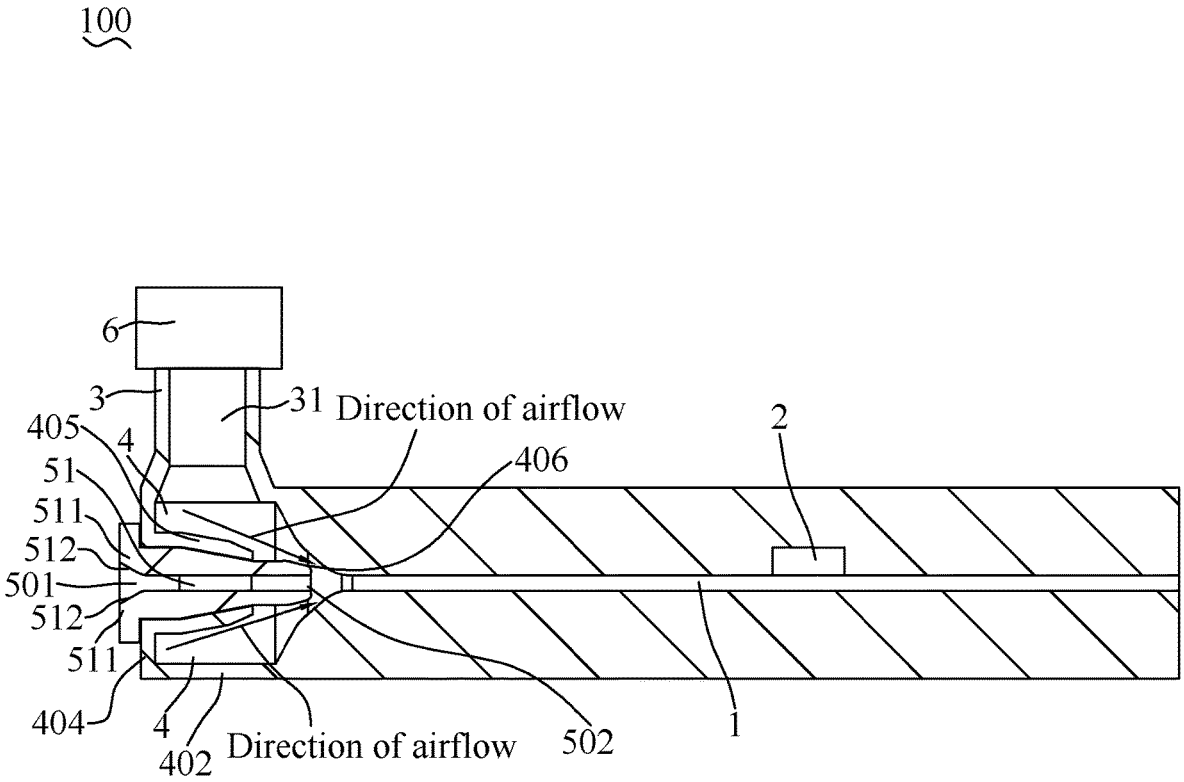
FIG. 6 is a sectional view of the pneumatic transmission device along a line VI-VI of FIG. 5.
Figure 7:
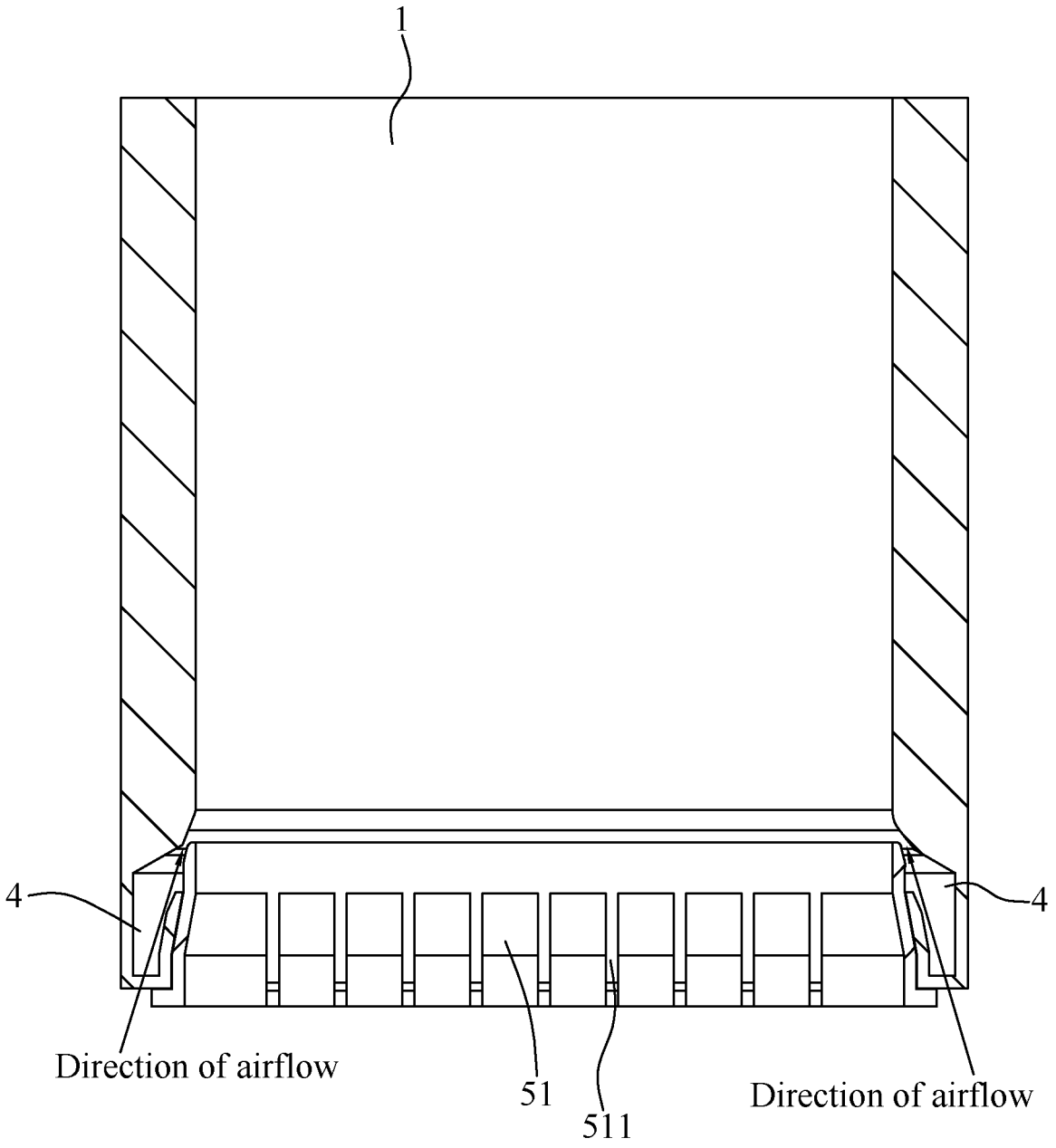
FIG. 7 is a sectional view of the pneumatic transmission device along a line VII-VII of FIG. 5.
Figure 8:
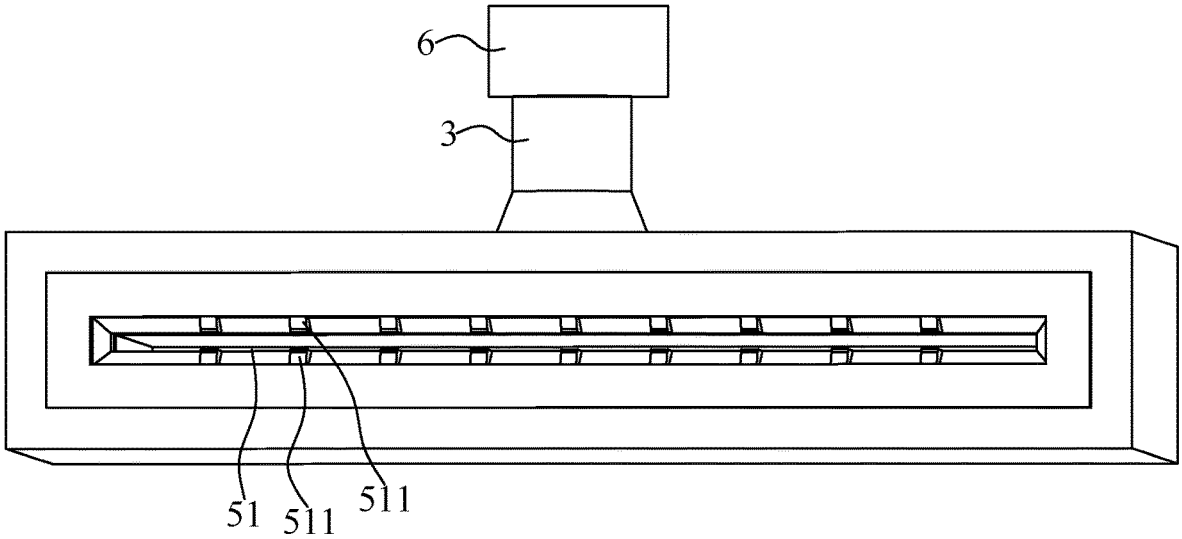
FIG. 8 is another perspective view of the pneumatic transmission device in accordance with the third preferred embodiment of the present invention.

Referring to FIG. 3 and FIG. 4, the pneumatic transmission device 100 in accordance with a second preferred embodiment of the present invention is shown. Differences between the pneumatic transmission device 100 in accordance with the second preferred embodiment and the pneumatic transmission device 100 in accordance with the first preferred embodiment are described as follows. In the second preferred embodiment, the second feeding path 12 of the transmitting channel 1 is shown as a lying U shape. The transmitting channel 1 is shown as another lying U shape. A mouth of the lying U-shaped second feeding path 12 faces frontward. The rear end of the compressing path 13 extends rearward, then is arched rearward and further extends frontward to form the second feeding path 12. An initiating end 103 of the first feeding path 11 and the exit end 102 of the second feeding path 12 are located at the same side. After the paper enters the transmitting channel 1 from the initiating end 103 of the first feeding path 11, the paper is fed out from the transmitting channel 1 from the exit end 102 of the second feeding path 12, correspondingly, the paper returns to the side where the initiating end 103 of the first feeding path 11 through the lying U-shaped second feeding path 12. The initiating end 103 of the first feeding path 11 is defined as a paper putting side of the pneumatic transmission device 100, and the exit end 102 of the second feeding path 12 is defined as a paper taking side of the pneumatic transmission device 100. The paper putting side and the paper taking side are disposed at the same side, so a convenience of the pneumatic transmission device 100 is increased in use.

Referring to FIG. 5 to FIG. 8, the pneumatic transmission device 100 in accordance with a third preferred embodiment of the present invention is shown. Differences between the pneumatic transmission device 100 in accordance with the third preferred embodiment and the pneumatic transmission device 100 in accordance with the first preferred embodiment and the second preferred embodiment are described as follows. In the third preferred embodiment, the pneumatic transmission device 100 further includes a chamber 4 and a paper feeding section 5. The transmitting channel 1 is shown as a rectangular shape. The scanning unit 2 is mounted in the transmitting channel 1. The initiating end 103 of the transmitting channel 1 is connected with the chamber 4. The air inlet 3 is connected with a front end of the top wall 401 of the transmitting channel 1. The air inlet 3 is extended upward from the top wall 401 of the transmitting channel 1 and projects beyond the top wall 401 of the transmitting channel 1. The passageway 31 is communicated with the chamber 4. A top end of the air inlet 3 is connected with the air supply device 6. The passageway 31 is connected with the air supply device 6. The air supply device 6 sends the high pressure air into the passageway 31. A rear end of the paper feeding section 5 is inserted into the chamber 4, so that the rear end of the paper feeding section 5 is surrounded by the chamber 4.

The chamber 4 is formed in a front end of the transmitting channel 1. The chamber 4 is surrounded among the bottom wall 402 of the transmitting channel 1, opposite side walls 403 of the transmitting channel 1, a front wall 404 of the transmitting channel 1, the top wall 401 of the transmitting channel 1, an inner periphery wall 405 of the transmitting channel 1 and an outer surface 406 of the rear end of the paper feeding section 5. The front wall 404 of the transmitting channel 1 is formed an entry mouth. The inner periphery wall 405 is extended from a periphery of the entry mouth and extended rearward. The inner periphery wall 405 is extended into the transmitting channel 1. The paper feeding section 5 is inserted into the transmitting channel 1 through the entry mouth. An air outlet mouth of the paper feeding section 5 is aligned with the initiating end 103 of the transmitting channel 1. The paper feeding section 5 abuts against the inner periphery wall 405. The rear end of the paper feeding section 5 is positioned at an intersection between the initiating end 103 of the transmitting channel 1 and an air output mouth of the chamber 4. The high pressure air is guided by the outer surface 406 of the rear end of the paper feeding section 5 and then flows into the transmitting channel 1. A top of the chamber 4 is opened and communicated with the passageway 31.

The paper feeding section 5 has a paper feeding channel 51. A height of a front end of the paper feeding channel 51 is higher than a height of the transmitting channel 1. The front end of the paper feeding channel 51 is defined as an importing end 501 of the paper feeding channel 51. A rear end of the paper feeding channel 51 is defined as an exporting end 502 of the paper feeding channel 51. A height of the importing end 501 of the paper feeding channel 51 is higher than the height of the transmitting channel 1. A top and a bottom of the paper feeding channel 51 gradually shrink towards each other from the importing end 501 of the paper feeding channel 51 to the exporting end 502 of the paper feeding channel 51. A design of the paper feeding channel 51 increases the airflow speed of the paper feeding channel 51 from the importing end 501 to the exporting end 502, so that the paper adsorption effect is improved. The exporting end 502 of the paper feeding channel 51 is connected to the chamber 4, and the exporting end 502 of the paper feeding channel 51 is close to the transmitting channel 1. The air flows into the pneumatic transmission device 100 through the importing end 501 of the paper feeding channel 51. Several portions of inner surfaces of a top wall and a bottom wall of the importing end 501 of the paper feeding channel 51 protrude inward and extend longitudinally to form a plurality of guiding sections 511. The plurality of the guiding sections 511 project into the importing end 501 of the paper feeding channel 51. A front surface of each guiding section 511 is an oblique guiding surface 512 located at the importing end 501 of the paper feeding channel 51. The guiding surfaces 512 of the plurality of the guiding sections 511 are inclined inward and rearward from front to rear. When a user puts the paper into the pneumatic transmission device 100, the guiding surfaces 512 of the plurality of the guiding sections 511 guide the paper into the paper feeding channel 51 to make the paper feeding channel 51 collect the paper, so that the user conveniently places the paper into the pneumatic transmission device 100 for scanning.

When the high pressure air enters the chamber 4 from the passageway 31, one part of the high pressure air flows into the transmitting channel 1 directly, and the other part of the high pressure air flows in the chamber 4 to generate a circular air flow in the chamber 4, and then the other part of the high pressure air flows into the transmitting channel 1.

When the air supply device 6 sends the high pressure air into the passageway 31, the high pressure air flows into the chamber 4 through the passageway 31, and then the high pressure air flows into the transmitting channel 1 through the chamber 4, and finally the high pressure air is fed out of the pneumatic transmission device 100 from the exit end 102 of the second feeding path 12 of a distal end of the transmitting channel 1. The air in the transmitting channel 1 is affected by the high pressure air, and the air in the transmitting channel 1 is accelerated to flow towards the distal end of the transmitting channel 1, at the moment, the air pressure in the transmitting channel 1 is less than the air pressure in the paper feeding channel 51 to form a pressure difference between the transmitting channel 1 and the paper feeding channel 51. The pressure difference between the transmitting channel 1 and the paper feeding channel 51 prompts that the air flows from the position with the higher air pressure to the position with the lower air pressure, so that the air in the paper feeding channel 51 flows into the transmitting channel 1, and then the Venturi effect is formed in the paper feeding channel 51. The adsorption force towards the transmitting channel 1 is generated in the paper feeding channel 51.

When the user puts the paper into the paper feeding channel 51 of the paper feeding section 5, the paper is attracted to move towards the transmitting channel 1 by the adsorption force, and the adsorption force is generated by the Venturi effect, so that the paper enters the transmitting channel 1 and the paper is pushed by the high pressure air to move to the distal end of the transmitting channel 1. When the paper passes under the scanning unit 2, the scanning unit 2 scans the paper. Finally, the paper passes through the distal end of the transmitting channel 1 and the paper is fed out of the pneumatic transmission device 100, so the pneumatic transmission device 100 completes transmitting and scanning the paper.

In the first preferred embodiment and in the second preferred embodiment, when the high pressure air flows into the second feeding path 12 through the passageway 31, some of the high pressure air flows back to the first feeding path 11, and a turbulence flow is generated, at the moment, an adsorption effect in the first feeding path 11 is affected. In the third preferred embodiment, when the high pressure air enters the chamber 4 from the passageway 31, one part of the high pressure air flows into the transmitting channel 1 directly, and the other part of the high pressure air flows in the chamber 4 to generate a circular air flow in the chamber 4, and then the other part of the high pressure air flows into the transmitting channel 1, the other part of the high pressure air is without flowing back to the paper feeding channel 51, so that the high pressure air completely flows into the transmitting channel 1 from the chamber 4, the paper feeding channel 51 is without being interfered by a high pressure airflow. When the pneumatic transmission device 100 according to the third preferred embodiment is compared with the pneumatic transmission device 100 according to the first preferred embodiment and the second preferred embodiment, the pneumatic transmission device 100 according to the third preferred embodiment has a more effective adsorption effect. The pneumatic transmission device 100 is used for proceeding with a paper transmission by the high pressure airflow.

As described above, the high pressure airflow is injected into the passageway 31 to form the Venturi effect by virtue of the air inlet 3 of the pneumatic transmission device 100, so that the paper is attracted into the pneumatic transmission device 100 by the adsorption force generated via the Venturi effect. Therefore, a mechanical structure design of the pneumatic transmission device 100 is simplified, and the pneumatic transmission device 100 achieves a paper scanning effect. Furthermore, the pneumatic transmission device 100 is used for proceeding with a paper transmission by the high pressure airflow, the pneumatic transmission device 100 is capable of maintaining a transmission function and saving a required dimension in a configuration of the pneumatic transmission device 100.

What is claimed is:

1. A pneumatic transmission device adapted for being mounted to a scanner or a printer, comprising:

a chamber;

a transmitting channel, an initiating end of the transmitting channel being connected with the chamber, the transmitting channel being equipped with a scanning unit or a printing unit;

an air inlet extended upward from a top wall of the transmitting channel, an inside of the air inlet defining a passageway penetrating through a top and a bottom of the air inlet, the passageway being communicated with the chamber;

an air supply device, a top end of the air inlet being connected with the air supply device, the passageway being connected with the air supply device, the air supply device injecting high pressure air into the passageway of the air inlet; and a paper feeding section having a paper feeding channel, a top and a bottom of the paper feeding channel gradually shrinking towards each other from an importing end of the paper feeding channel to an exporting end of the paper feeding channel, a rear end of the paper feeding section being inserted into the chamber, so that the rear end of the paper feeding section being surrounded by the chamber, wherein when the high pressure air enters the chamber from the passageway, a first part of the high pressure air flows into the transmitting channel directly, and a second part of the high pressure air flows in the chamber to generate a circular air flow in the chamber, and then the second part of the high pressure air flows into the transmitting channel.

2. The pneumatic transmission device as claimed in claim 1, wherein a front end of the paper feeding channel is defined as the importing end of the paper feeding channel, a rear end of the paper feeding channel is defined as the exporting end of the paper feeding channel, a height of the importing end of the paper feeding channel is higher than a height of the transmitting channel.

3. The pneumatic transmission device as claimed in claim 1, wherein air flows into the pneumatic transmission device through the importing end of the paper feeding channel, several portions of inner surfaces of a top wall and a bottom wall of the importing end of the paper feeding channel protrude inward and extend longitudinally to form a plurality of guiding sections, the plurality of the guiding sections project into the importing end of the paper feeding channel.

4. The pneumatic transmission device as claimed in claim 3, wherein a front surface of each guiding section is an oblique guiding surface located at the importing end of the paper feeding channel, the guiding surfaces of the plurality of the guiding sections are inclined inward and rearward from front to rear.

* * * * *